United States Patent [19]

Dammann et al.

[11] 4,321,789

[45] Mar. 30, 1982

[54] PROCESS FOR SPINNING OF CORE/MANTLE YARNS AND YARN PRODUCTS

[75] Inventors: Peter Dammann; Heinz Schippers; Herbert Turk, all of Remscheid; Herbert Schiminski, Hückeswagen, all of Fed. Rep. of Germany

[73] Assignee: BARMAG Barmer Maschinenfabrik AG, Remscheid, Fed. Rep. of Germany

[21] Appl. No.: 145,822

[22] Filed: May 1, 1980

Related U.S. Application Data

[63] Continuation of Ser. No. 927,015, Jul. 24, 1978, abandoned, which is a continuation-in-part of Ser. No. 782,310, Mar. 28, 1977, Pat. No. 4,130,983.

[30] Foreign Application Priority Data

Mar. 27, 1976 [DE] Fed. Rep. of Germany ..... 2613263
Jul. 25, 1977 [DE] Fed. Rep. of Germany ..... 2733454

[51] Int. Cl.[3] ..... D01H 1/12; D02G 1/02; D02G 3/36

[52] U.S. Cl. ..... 57/224; 57/5; 57/7; 57/58.95; 57/226; 57/228; 57/232; 57/287; 57/295; 57/297; 57/901

[58] Field of Search ..... 57/5, 7, 6, 58.89–58.95, 57/224, 286–288, 295, 297, 225, 226, 228, 901

[56] References Cited

U.S. PATENT DOCUMENTS

| | | | |
|---|---|---|---|
| 1,950,988 | 3/1934 | Luttenberger | 57/5 X |
| 2,946,181 | 7/1960 | Tissot et al. | 57/297 |
| 3,137,991 | 6/1964 | Fairley | 57/228 X |
| 3,153,838 | 10/1964 | Pinson, Jr. | 57/228 X |
| 3,234,724 | 2/1966 | Storti | 57/225 |
| 3,481,135 | 12/1969 | Devold | 57/225 X |
| 3,639,807 | 2/1972 | McCune | 57/901 X |
| 3,835,638 | 9/1974 | Mayer, Jr. et al. | 57/5 X |
| 3,913,310 | 10/1975 | Fehrer | 57/58.89 X |
| 4,130,983 | 12/1978 | Dammann et al. | 57/5 |

*Primary Examiner*—John Petrakes
*Attorney, Agent, or Firm*—John H. Shurtleff

[57] ABSTRACT

A process for the production of a core/mantle yarn, in which a core thread is continuously conducted through a spinning zone in a gap formed between two adjacent and oppositely moving surfaces; staple fibers are fed into the path of the core thread and come into frictional contact with the moving surfaces in said zone to spin the staple fibers about the core thread; the core thread is preferably stretched during the spinning in order to bring about a defined, predetermined elastic stretch of the core thread in the spinning zone; and the core thread has a roughened surface which may be obtained by using a staple fiber yarn or thread obtained by texturizing, weaving, twisting, etc. The invention is especially characterized by an improved adherence of the fibers of the mantle to the core thread by pre-coating the core thread with an adhesive, or preferably by preapplying colloidal silicic acid to the core thread.

13 Claims, 10 Drawing Figures

PROCESS FOR SPINNING OF CORE/MANTLE YARNS AND YARN PRODUCTS

This is a continuation, of application Ser. No. 927,015 filed July 24, 1978, now abandoned, which in turn is a continuation-in-part of earlier application Ser. No. 782,310, filed Mar. 28, 1977, now U.S. Pat. No. 4,130,983.

BACKGROUND OF THE INVENTION

German published patent specification OS 24 64 400 discloses a process for the production of a yarn by winding of continuous filament yarns about staple fiber bands. The breaking stretch of the winding filament yarn is at least equal to the breaking stretch of the spun fibers. The strength elongation characteristic of the spun fibers and that of the winding filament yarn are to be attuned to one another in the sense that the initial modulus of the winding filament yarn is great and thereby in stretch stress of the filament yarn there is rapidly built up a sufficently high tension. This leads to filament yarns consisting of smooth fibers, which correspondingly leads to textile disadvantages. The strength factor of the winding filaments, therefore is very low, and therefore, they contribute little to the strength properties of the core/mantle yarn.

It is further known from German published patent specification OS 26 27 220 that endless threads (filament yarns) can be joined together with staple fibers (spinning fibers).

It has proved it hitherto was possible, to be sure, to attain an improvement of the textile properties of the filament yarn, but it was not possible to bring about any appreciable increase of the strength properties. It was not possible to bring the strength properties of the core thread in harmony with the strength properties of the spun fibers (staple fibers) in such a way that a summation takes place of the strength properties.

Attainment of core/mantle yarns with improved strength properties is the basic objective of this inventiion.

BRIEF DESCRIPTION OF THE INVENTION

The invention herein provides processes and apparatus for the production of a core/mantle yarn, in which the core thread is drawn at a constant rate through a spinning zone and staple fibers are spun thereabout to form a mantle. The core thread is pre-stretched in the spinning zone to such an extent that, at the desired reference strength of the finished core/mantle yarn, the specific strength of the core thread is greater than or equal to the specific reference strength of the finished core/mantle yarn.

The core thread in the sense of this invention may be a filament yarn or—which equivalent—a multifilament yarn of endless monofilaments, preferaby textile polymer filaments. The core thread, however, may also be a thread spun from textile fibers—or what is equivalent—a thread spun from staple fibers. Here, natural fibers or textile polymer fibers can be used.

The mantle fibers are in any case staple or spinnable fibers. It is a matter of choice whether they are natural fibers, such as, for example, cotton, or textile synthetic polymer fibers.

The process of the invention assures that, on the one hand, a very high yarn strength is achieved through summation of the strength properties of both yarn constituents. On the other hand, the exterior of the core mantle thread can be modified in such a way that improvements in appearance and feel or other excellent textile properties can be realized.

By reference strength and reference elongation in the sense of this invention there is meant the force that is required to elongate the finished core/mantle yarn by a certain prescribed amount, the reference elongation.

The reference elongation is there a value selected by the yarn producer or processor, which is selected in the scope of the possibilities imparted to the material by the processsing conditions—for example tensile and stretch strains in the weaving machine—and to strains occurring in use in such a way that there are attained the optimum processing and/or use properties.

Preferably the reference force lies in the range of 20% to 80% of the tearing strength of the finished core mantle thread. In the determination of the reference stretch it is very essential also to take into account the composition of the core/mantle thread. If the core mantle thread contains substantial components of natural fibers, for example cotton, the reference stretch—depending on the type of cotton—can amount to 6% to 12% at the upper limit and ca. 2% at the lower limit.

The mantle fibers serve above all the purpose of influencing in a favorable manner the appearance, the feel and the wear properties of the core/mantle yarn and of the products made from it. Preferably they are natural fibers, in particular cotton. Also possible, however, is the use of spinnable fibers (staple fibers) of synthetic polymers used in textiles. For this, endless filaments can be supplied as a band to a tearing or cutting mechanism used for direct conversion into staple fibers, which are fed to the spinning installation.

Of spinning processes for the practice of the process of the invention several processes are available. They are open-end spinning processes, such as, for example, air turbulence processes or processes in which spinning fibers are twisted together on one or more moving surfaces into a fiber yarn. In particular, a process according to the disclosure of our aforesaid U.S. application as well as in German application P 26 56 787.3, are preferred.

The use of such spinning processes in conjunction with the process of this invention leads, therefore, to an especially favorable combination, because this spinning process in no way influences the course of the core thread. Further, the combination of the process of the invention with the spinning process according to the aforesaid patent disclosures makes possible in an especially suitable manner the prestretch of the core thread in the spinning zone, since both processes make possible a straight course of the core thread through the fiber spinning zone.

The core thread is such that the mantle fibers adhere well to it. For this reason preferably core threads with roughened surface are used. It is possible, for example, to use as the core thread a staple fiber yarn which is spun in a continuous process operated in association with the process of the invention.

The spinning rollers may also be hyperboloids, especially asymmetric hyperboloids, the core thread running axially from the largest end to the smallest end of the asymmetric hyperboloids.

For the increase of the strength and stretch properties of the core/mantle yarn it is suggested, as preferred, a texturized synthetic polymer thread be used as the core thread. The texturizing can be achieved, in particular, by false twisting. It is also possible to carry out the false-twist texturizing continuously just ahead the spinning process of the invention. As usual, the core thread is conducted over a heating arrangement, thereupon twisted and then conducted through a false-twist apparatus. The core thread is then spun after the false twister. The zone in which the false twist occurs may run back also the stretching into the stretching zone.

Another possiblity for the texturizing is, in particular, the stuffing chamber or the air nozzle texturizing. A roughened surface is obtained on the filament thread also by the means that using an air stream impinging transversely on the filaments in a manner wherein they become interlaced with one another. Such processes are sometimes called "tangle" processes.

A further possiblility for the roughening of the surface lies in twisting the core thread.

All these possibilites listed for the roughening of the surface are essentially determined by processing and use conditions for the core/mantle yarn generated. It may also be expedient to use a smooth core thread, which is first preheated with an adhesive that can be washed out. This results in a well sheathed and durable core/mantle yarn which has good working properties. Only after incorporating of the yarn into a textile structure by weaving, knitting, fine-knitting or the like is the adhesive washed out, since then the cohesion between core and mantle fibers is assured in another manner.

Especially for the production of carpet yarns it is useful to supply an electrically conducting core thread—possibly together with other treated core threads—as described earlier—to the spinning zone.

It was further found that the process of the invention, through a heat treatment of the freshly spun core/mantle yarn, preferably by heating the finished core/mantle yarn passing over a heated surface, e.g., a hot contact plate, provides yarns with special effects. In particular, the shrinkage properties of the core thread and of the mantle fibers can be adapted to one another, or through different shrinkage properties, special swelling effects result or that the stretch (elongation) properties can be influenced in a special way. Use of these process modifications are greatly dependent on the desired structure of the core/mantle yarn and on its intended processing and use.

A further object of the invention is to provide a core/mantle yarn which can be produced in particular by the processes described herein. This core/mantle thread yarn is characterized in that the core thread is multifile synthetic polymer which is crimped, preferably three-dimensionally crimped, and is twisted about the staple fibers. The specific strength of the core thread at reference stretch of the core/mantle yarn is greater than the specific reference strength of the core/mantle yarn.

The specific strength in the sense of this invention is a fineness-referred tensile strength, which is given, for example, as tearing length in the dimension:

$$Km = \frac{p}{\text{tex}} = \frac{gr}{\text{tex}} \approx \frac{cN}{\text{tex}}$$

To determine the prestretch of the core thread in the spinning zone, therefore, according to the invention, first the desired reference stretch and the desired reference strength of the finished core/mantle yarn are determined. There is then determined in the force-stretch diagram of the core thread, for a specific strength which is greater than the reference strength of the finished core/mantle yarn, the appertaining stretch (elongation). This stretch minus the reference stretch then yields the prestretch at which the core thread is conducted in the spinning zone.

The spinning device of the invention is an open-end spinning device with an open-end spinning zone through which the core thread can travel, especially a spinning device as disclosed in the aforesaid U.S. and German applications. The spinning device according to the invention is characterized by having its spinning zone located between two thread delivery mechanisms that are driven at a constant, adjustable translation ratio.

For the production of a core thread of staple fibers—be it natural fibers or synthetic polymer fibers—there can be provided ahead of the spinning device of the invention another spinning device. For the modification of a core thread which consists of endless filaments, the spinning device of the invention can have ahead of its inlet side a texturizing unit. This texturizing unit may be positioned before the first delivery mechanism. The process of the invention and the appratus in its further development offers, however, the advantageous possibility of arranging both the texturizing arrangement and also the spinning device between the two delivery mechanisms, thereby providing a simple and economical machine construction.

For the production of the mantle fibers there can be arranged in front of the spinning device of the invention a tearing or cutting mechanism for endless synthetic polymer filaments. In this development of the spinning device of the invention it is possible, avoiding any intermediate processing, to spin a core/mantle yarn, starting with endless polymer filaments, on a single spinning machine.

The process of the invention permits conducting the core thread through the spinning zone (where spinning fibers or staple fibers are spun thereabout) at a precalculated stretch and tension. For production of core/mantle yarns with prescribed properties, it is especially advantageous if the core thread is pretwisted in the spinning zone to such an extent that, at the desired reference stretch of the finished core/mantle yarn, the specific strength of the core thread is greater than or equal to the specific reference strength of the finished core/mantle yarn, whereby the core thread is subject to approximately the same stretch relations as the mantle and, in the process, takes over the main loads imposed on the yarn. A possibility of exerting the necessary pull force on the core thread in the spinning zone exists also with the use of hyperboloids as spinning rollers, which are adjusted in such a way that they exert an axial conveying force on the core thread.

It has proved especially advantageous if the core thread is pretreated after the first delivery mechanism and before the entry into the spinning zone with a colloidal silicic acid, i.e., $(H_2Si_2O_5)_x$ in colloidal solution, a commercially available composition. The colloidal silicic acid preferably has a 50 to 90% water content. It is applied preferably in amounts calculated as dry substance, of less than 0.5% of the thread weight, most preferably less than 0.3% by weight. The applied amount of colloidal silicic acid preferably can be controlled by conducting the thread at a certain encircling arc over a finishing roller driven in rotation, which dips in part into a container with the application medium (silicic acid) and which is driven at a controllable speed of rotation. For example, the colloidal silicic acid may be applied to the core thread by means of a rotably driven finishing roller which dips into a container of the acid as a thread finishing fluid, the core thread contacting said roller circumferentially outside of the container over an angle of more than 30°, and the finishing roller being rotatably driven at a controllable predetermined circumferential velocity.

By the application of colloidal silicic acid to the thread the quality of the core/mantle yarn can be very substantially improved. In particular, hereby the so-called "push-on tendency" is reduced to virtually to zero. By "push-on tendency" there is meant the following:

In the wrapping of a core thread with staple fibers there is present the danger that part of the mantle, consisting of staple fibers, upon running through thread-guide elements—such as are usual and necessary in yarn working and yarn processing (especially in weaving and knitting)—is pushed or slid on the core thread to form an acummulation of thickening of mantle fibers. Thereby the core thread becomes partially denuded of mantle fibers. The accumulation of the mantle fibers leads, in the case of yarn treatment or processing, very easily to yarn breakage and results, in the finished textile structure (knit or woven) to an uneven appearance. It, therefore, becomes necessary to reduce the push-on tendency, i.e., by improving the adhesion of the mantle fibers to the core thread. One measure for determining the push-on tendency is the so-called "push-on length". This is determined by conducting the core thread through a narrow gap, in front of which the spun fibers of the mantle are restrained. The core thread is then loaded with a weight which amounts to approximately half the tearing strength of the core/mantle yarn. In consequence of this weight load, the core thread tends to be drawn by a certain amount through the gap, while it is held fast by the restrained mantle fibers. The weight also is fastened to a gap plate, the gap of which corresponds approximately to the diameter of the core thread. Ahead of this gap plate occurs an accumulation of stripped-off mantle fibers. The length of core thread bared in this way of mantle fibers is called the "push-on length".

By application of colloidal silicic acid to the core thread, even with less than the aforesaid 0.3% applied amount, based on the core thread weight, it was possible to reduce the push-on length of a thread having no finish application from one in the range of 40 cm to an immeasurably small push-on length for the colloidal silicic acid-coated-core thread.

ILLUSTRATED EMBODIMENTS

Preferred forms of the invention are described below, in conjunction with the drawings, wherein:

IN THE DRAWINGS

Figure 1:
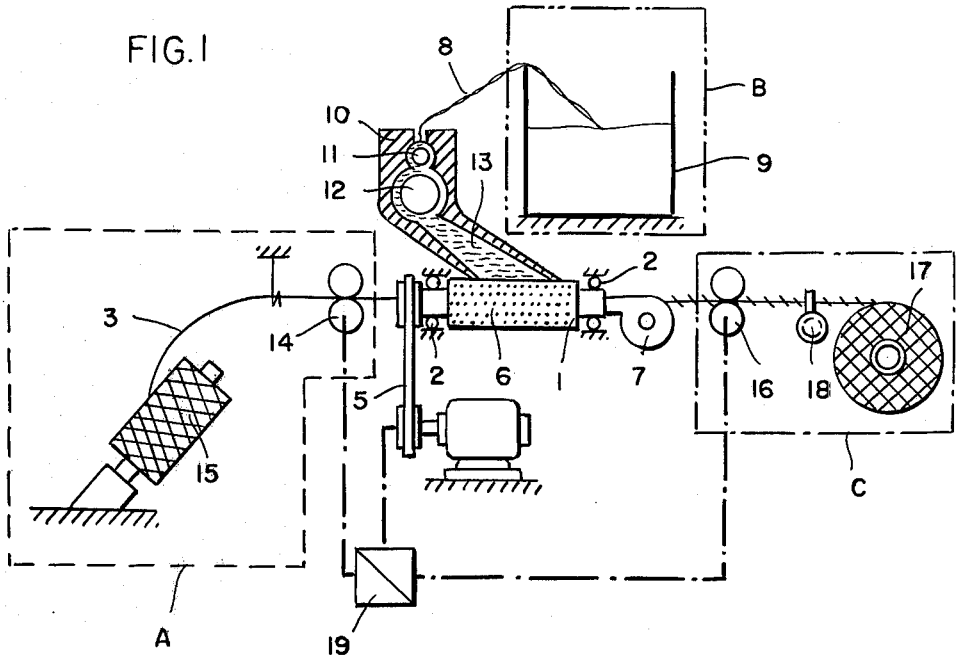
FIG. 1 is a diagrammatic side elevation, partly in section, of a spinning apparatus for the production of a core/mantle according to this invention.

In FIG. 1 there schematically shown is the spinning device which—as in the aforesaid U.S. and German applications—consists of two air permeable, rotatable perforated drums 1 that are journalled in bearings 2 and are driven via drive belt 5 by motor 4 in the same direction. The side-by-side drums are provided with many perforations 6. By the suction arrangement 7 an air stream is drawn into each drum in the region of the fiber spinning zone in the gap between the drums. For further details reference is made to the above-mentioned U.S. application.

The core thread 3, in which thread is drawn off from the run-off bobbin 15, is supplied to the spinning device. Further modifications for the production of the core thread are represented in FIGS. 2 to 5. The core thread is conducted through (or at least a short distance in) the narrowest gap formed between the two drums 1. To this gap there are also fed the staple fibers supplied from the resolving and feeding unit 10. From the can 9 the fiber or filament cable 8 is drawn off by means of the roller mechanism 11 and fed to the resolving roller 12. The fiber cable is resolved by the toothed roller 12 into individual, discrete fibers. The individual fibers are conveyed in an airstream through the fiber feed channel 13 into the gap between the rollers 1 and, namely, in such a way that in the process they are straightened as much as possible. The finished spun core/mantle yarn is drawn off by delivery mechanism 16 from the spinning zone and, with reciprocation by the transverse unit 18, is wound on the winding bobbin 17.

The delivery mechanisms 14 and 16 are operatively connected through gear 19. Gear 19 is adjustable so that the desired translation ratio between the delivery mechanisms 14 and 16 can be set selectively.

Figure 2:
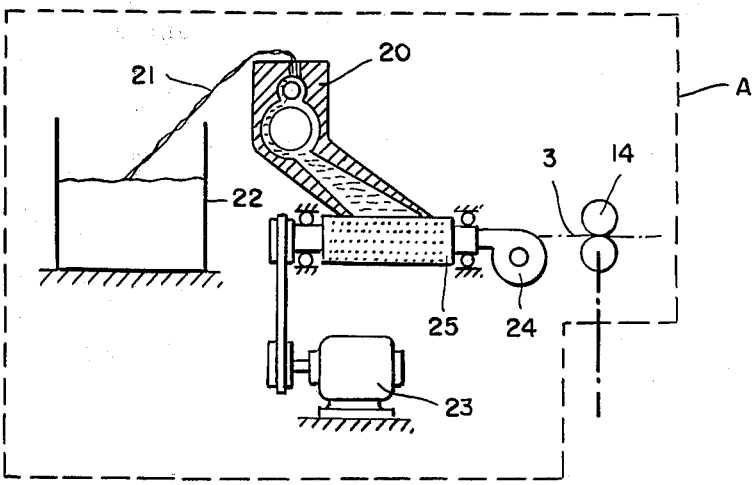
FIG. 2 is a diagrammatic side elevation, partly in section, of a spinning device for generating a core thread of staple fibers.

The unit of FIG. 2 may be substituted for the parts enclosed in block A of FIG. 1 and illustrates the production of a core thread of staple fibers in a continuous process to be used in association with the production of the core/mantle yarn according to this invention.

A spun fiber or filament cable 21 is drawn off from the can 22 by means of the resolving and feed unit 20. The resolving and feed unit 20 is constructed like the resolving and feed unit 10 in FIG. 1. The descrete fibers are fed to the spinning unit 25 of like construction to the spinning unit of FIG. 1. The perforate drums are driven by motor 23 and contain like suction arrangements 24. The core thread 3 is generated by the spinning unit 25, which is drawn off by the delivery mechanism 14—identical with the delivery mechanism 14 in FIG.

1—and is supplied to the spinning unit represented in FIG. 1 as core thread.

Figure 3:
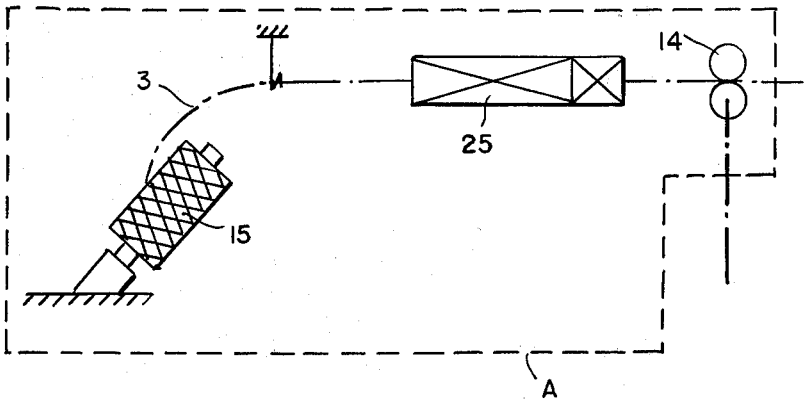
FIG. 3 is a diagrammatic side elevation of a texturizing arrangement for the continuous texturizing of the core thread fed to the spinning device.

In FIG. 3, another combination useful as the block A in FIG. 1 provides a texturizing of the core thread of filament yarn. The core thread is drawn off from the bobbin 15. In the texturizing unit, (for example, a compression or stuffing chamber, an air crimping unit or a tangle unit) imparts texture to the thread being drawn therethrough by the first delivery mechanism 14, which is also represented in FIG. 1.

Figure 4:
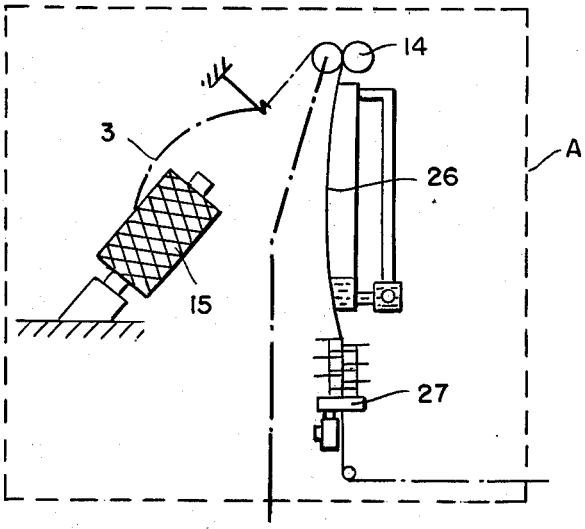
FIG. 4 is a diagrammatic side elevation of a false twist device for the falst-twist crimping of a synthetic textile polymer thread serving as core thread on the spinning machine.

The apparatus shown in FIG. 4 may be used as the block A in FIG. 1 to attain false-twist texturizing of the core thread. The core thread 3 is drawn off from the bobbin 15 through the first delivery mechanism 14 and thereupon guided over the heating plate 26 as well as through the false twister 27 before it runs into the spinning device represented in FIG. 1. The heating plate 26 is heated by the vapor condensation heating principle. In the lower part of the heating system forming a closed cavity there is a fluid which is heated by an electric heating resistance. The pressue in the system is adjustable. Twist is applied by the known disc-type twisting unit 27.

The false twister may be any known type, e.g., as described in German published patent specification OS 22 13 881.

In FIG. 5, which again has apparatus useful as block A in FIG. 1, there is likewise shown apparatus for the false-twist texturizing of the core thread 3 as in FIG. 4. The difference lies in that in FIG. 5 an unstretched core thread, for example of polyethylene terephthalate, is presented. This is simultaneously stretched and false-twist texturized between the delivery mechanisms 28 and 14. The delivery mechanism 14 is identical with that represented in FIG. 1. The delivery mechanisms 14 and 28 are, moreover, likewise in operative connection with adjustable translation ratio by the gear 19.

Figure 6:
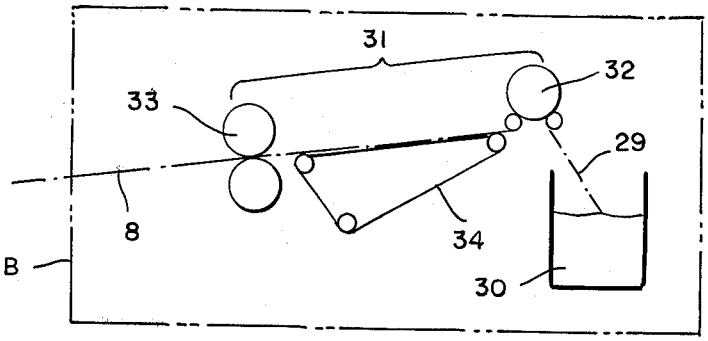
FIG. 6 is a diagrammatic side elevation of a tearing; mechanism for generating mantle fibers from an endless filament cable.

FIG. 6 shows alternative apparatus for that in block B in FIG. 1 for the production of the discrete polymer fibers from a cable 29 of the synthetic fibers. The cable 29 is drawn off from the can 30 and converted in the tearing mechanism 31, which has a usual construction type, into a spinning cable 8. The spinning fiber cable 8 is then—as represented in FIG. 1—supplied to the feed and resolving unit 10. The tearing mechanism 31 consists in the case represented of the two roller mechanism 32 and 33, between which extends the conveyor belt 34.

Figure 7:
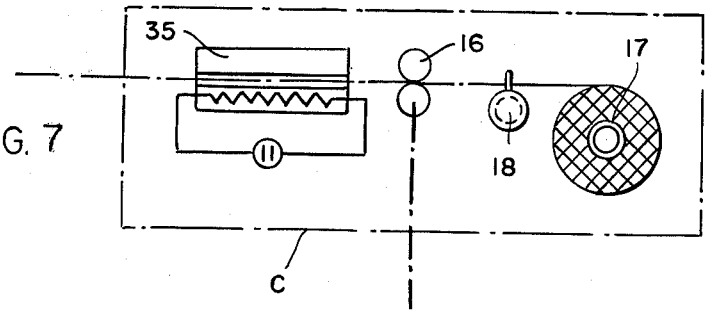
FIG. 7 is a diagrammatic side elevation of a heating arrangement for the heat treatment of the spun core/-mantle yarn adjacent to the spinning zone.
Figure 8:
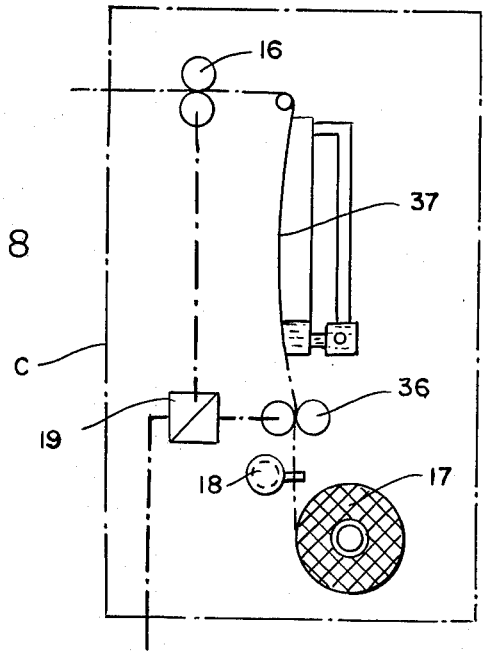
FIG. 8 is a diagrammatic side elevation of a heating arrangement for heat treatment and stretching of the spun core/mantle yarn.

FIGS. 7 and 8 show heating units serving as alternatives in block C in FIG. 1 and provide for modification of the freshly spun core/mantle yarn by a heat treatment. According to FIG. 7 the heat treatment takes place by means of a contact-free passage of the yarn through the heater 35 just ahead of the delivery mechanism 16. Such a heat treatment is useful, for example, to render the core/mantle yarn tension-free.

In FIG. 8 the heat treatment occurs between the delivery mechanism 16 (represented also in FIG. 1) and a further delivery mechanisms 36, which are operatively connected at an adjustable translation ratio. In FIG. 8 there is used a contact heating plate 37. The contact heating plate is likewise heated according to the vapor condensation principle. This arrangement according to FIG. 8 has the special advantage that the heat treatment of the finished core mantle thread can take place under a tension that is independent of the tension prevailing in the spinning zone. In particular, tensions can also be exerted on the mantle fibers, which at first is not the case in the spinning zone.

According to the invention, the core thread is conducted in the spinning zone between the delivery mechanism 14 and 16 by corresponding adjustment of the translation ratio with a certain prestretch. This prestretch is determined by first establishing the reference stretch of the finished core/mantle yarn. The core/mantle yarn has a certain tearing stretch, which corresponds to a tearing strength. Obviously, the core/mantle yarn must not be strained to the tearing point either in the processing or in use. Since the core/mantle yarn is composed of various components, there must be established, on the contrary, a reference stretch and a reference strength corresponding to this, which assures that no damage will take place to one of the components. Otherwise reference stretch and reference strength, however, also present a measure for the normal strains occurring in processing and use. The establishment of reference stretch and reference strength are in the province of problems of yarn producers and yarn processors.

The prestretch setting in the spinning about of the core thread should, according to the invention, be so great that in the case of normal load, therefore at reference stretch of the core/mantle yarn, the core thread absorbs the essential load.

Figure 5:
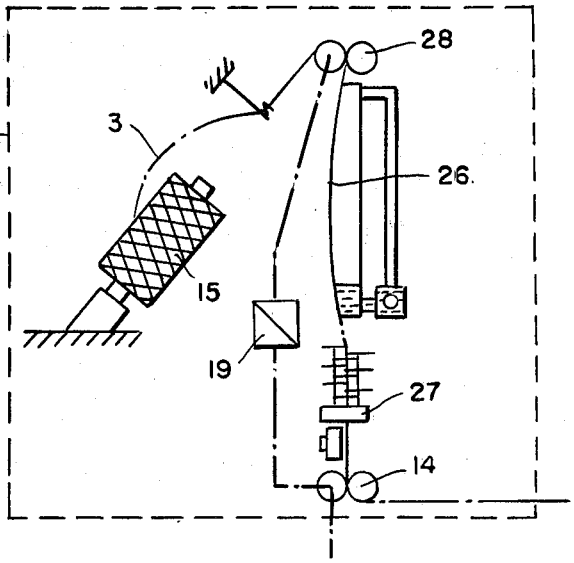
FIG. 5 is a diagrammatic side elevation of a false-twist and stretching device for the simultaneous stretch-texturizing of the core thread.

In comparative tests that are yielded from the following table, a core thread of polyethylene terephthalate 16 7 dtex=60 Nm was streteched in apparatus according to FIG. 5 in conjunction with FIG. 1, texturized and worked with cotton fibers, staple length 40 mm 1.7 dtex individual denier, Nm 40 into a core/mantle yarn Nm 24. The reference stretch of the finished core/mantle yarn was established at 8.5% with a reference strength of 18 km. The core thread was conducted in the first test with by-passing of the delivery mechanism 14. It proved that only a very poor and irregular adherence of the mantle fibers to the core threads occurred. The breaking stretch of the core thread was 31.5%. The specific tearing strength was, however, to only 16.3 km, and was thereby considerably worse than in the case of the core/mantle yarn.

In the parallel test, the core thread was prestretched between the delivery mechanism 14 and 16. Previously there had been determined the strength-stretch diagram of the core thread according to FIG. 9.

Moreover, it was established according to the invention that the core thread in the case of load of the reference load was to absorb the greater load of 21

$$\frac{p}{\text{tex}} = 21 \text{ Rkm.}$$

Figure 9:
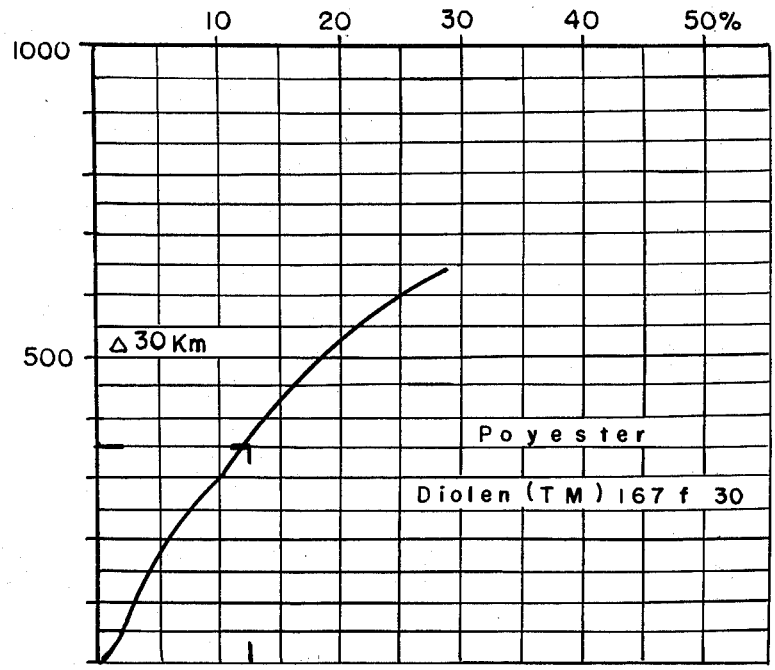
FIG. 9 is a strength-stretch diagrm of a core thread.

From the strength-stretch diagram according to FIG. 9 for this load there can be derived a stretch of 12.5% as the reference stretch (elongation) of the core thread.

The prestretch in the spinning zone was thereby determined as the difference between the reference stretches of the core/mantle yarn on the one hand and of the core thread on the other hand at 4% and correspondingly adjusted. The strength of the finished core/mantle yarn was thereby possible to increase beyond the prescribed reference strength.

TABLE

| | Core/mantle yarn | | | | Core thread | | |
|---|---|---|---|---|---|---|---|
| | A Ref. stretch [%] | B Specif. ref. strength [Rm] | C Tearing stretch [%] | D Spec. tearing strength [Km] | E Spec. strength [Km] at ref. stretch | F Stretch [%] at force E | G Prestretch [%] in spinning zone |
| Type of determination | Determined after material processing use | Strength-stretch diagram of the K-M thread | Test | Test | Determined according to E > B | Strength-stretch diagram of the core thread | G = F − R |
| State of the art | 8.5 | 18 | 31.5 | 16.3 unusable, since D < B | Not determined | Not determined | 0 |
| New process | 8.5 | 18 | 12.9 | 25.1 good, since D > B | 21 | 12.5 | 4 |

Figure 10:
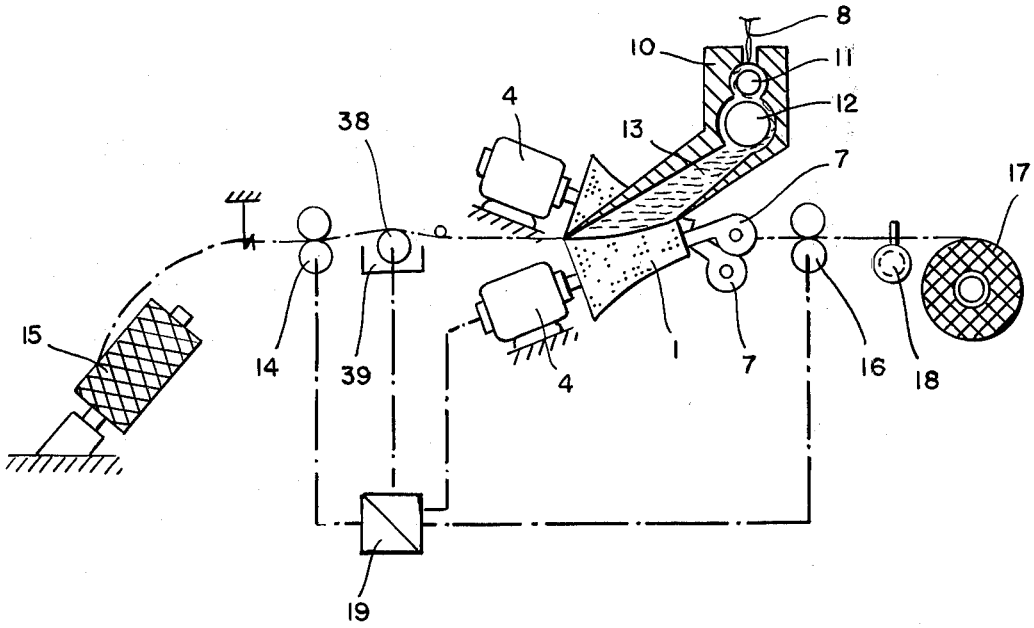
FIG. 10 is a diagrammatic side elevation of a spinning device with asymmetric hyperbolic spinning rollers and a unit for applying a liquid to the core thread.

In FIG. 10 there is illustrated a spinning device for the practice of the process of the invention, which device corresponds essentially to the device of FIG. 1. The same reference numbers as in FIG. 1, therefore, was retained insofar as the same designations apply. The core thread 3 is drawn off from the stationary delivery bobbin 15 through the first entry delivery mechanism 14 at a predetermined speed. The spinning device 1 consists in the example represented of asymmetrical hyperboloid sieve rollers or drums, the gap between which is traversed by the core thread 3 from the largest to the smallest end of the rollers or drums. Each of the hyperboloid rollers or drums is driven by a motor 4 of its own, the circumferential velocity of the two air permeable rollers being equal. The core mantle thread is drawn off by the delivery mechanism 16, is moved back and forth by traverse mechanism 18 and is wound on a cross-bobbin 17. The fibers for the mantle about the core thread are conducted as fiber cable 8 through the entry mechanism 11 and resolving roller 12 and then through fiber channel 13 into the narrow gap formed between the hyperbolic sieve drums or rollers. Air suction devices 7, the air entry orifices of which lie in the interior of each sieve drum, define the yarn formation line and zone.

A special feature in FIG. 10 is the finishing roller 38 positioned between the first delivery mechanism 14 and the spinning device 1. The finishing roller 38 is driven in rotation and dips partially into the finish container 39 where it is moistened continuously over its circumference with a suitable fluid. The turning rate of the finish roller can be attuned via the gear 19 with the speed of the first delivery mechanism 14 in such a way that a certain amount of fluid is constantly applied to the thread. It is worthwhile to apply only a small amount of fluid, in order to avoid any dirtying of the subsequent parts of the machine. In particular, use of colloidal silicic acid as application agent improves the properties of the core/mantle yarns and in particular, the push-on tendencies of the yarns are substantially improved, especially if amounts of less than 0.3% of the thread weight, calculated as dry colloidal silicic acid, is applied.

In the application of colloidal silicic acid to the core thread immediately before the spinning it becomes possible to produce a core/mantle yarn having no push-on tendency at all and in which the mantle fibers have, under normal load conditions, an insoluble bond with the core thread. In like manner numerous other finish agents that are usual in the textile industry were investigated. In no case was it possible to achieve any substantial improvedment of the push-on tendency. Even the addition of collodial silicic acid to other usual finish agents failed to bring the desired success. Rather, a worsening the push-on tendency was the result so that it is to be assumed that the colloidal silicic acid has a determinative significance for the production of qualitatively high-value core/mantle yarns. The reason(s) for this surprising property of colloidal silicic acid has not yet been found. Possibly a role is played by an increase of the thread, thread friction between core thread and mantle fibers and/or a crystallization of the silicic acid.

We claim:

1. In a process for the production of a core/mantle yarn, in which a core thread is continuously conducted in a straight line path through a spinning zone in a gap formed between two adjacent and oppositely moving surfaces, and in which staple fibers are fed into the straight line path of the core thread in such a way that the staple fibers come into frictional contact with the moving surfaces in said zone and are caused to be spun about the core thread, the improvement which comprises:

conducting the core thread at a first defined velocity into the spinning zone and drawing off said core thread during the spinning at a higher, second defined velocity in order to maintain a predetermined tension on the core thread in the spinning zone; and roughening the surface of the core thread before the staple fibers are spun thereabout.

2. A process according to claim 1, wherein the core thread is a staple fiber yarn.

3. A process according to claim 2, wherein the core thread is texturized prior to entering the spinning zone.

4. A process according to claim 1, wherein the core thread is a multifilament thread composed of continuous filaments which are interwoven with one another.

5. A process according to claim 1, wherein the core thread is twisted.

6. A process according to claim 1, wherein the core thread is pretreated with colloidal silicic acid before entry into the spinning zone.

7. A process according to claim 6, wherein the colloidal silicic acid has a 50 to 90% water content.

8. A process according to claim 6, wherein the application of the colloidal silicic acid, calculated as dry substance, amounts to less than 0.5% of the thread weight.

9. A process according to claim 8, wherein said application, calculated as said dry substance, amounts to less than 0.3% of the thread weight.

10. A process according to claim 6, wherein the moving surfaces of said spinning zone are provided by two spinning rollers have air permeable roller surfaces, air being suctioned through said surfaces into the roller during spinning, and the colloidal silicic acid is applied to the core thread during its delivery to the spinning rollers.

11. A process according to claim 6, wherein said colloidal silicic acid is applied to the core thread by means of the rotatably driven finishing roller, which dips into a container of said acid as a thread finishing fluid, the core thread contacting said roller circumferentially outside of said container and said fluid over an angle of more than 30°, and said finishing roller being rotatably driven at a controllable predetermined circumferential velocity.

12. A process according to claim 11, wherein said circumferential velocity is increased such that the colloidal silicic acid calculated as dry substance applied to said yarn, is less than 0.3% of the thread weight.

13. The yarn product obtained by th process of claim 1, 6, 8, 9 or 10.

* * * * *

UNITED STATES PATENT AND TRADEMARK OFFICE

CERTIFICATE OF CORRECTION

PATENT NO. : 4,321,789

DATED : March 30, 1982

INVENTOR(S) : Dammann et al

It is certified that error appears in the above-identified patent and that said Letters Patent are hereby corrected as shown below:

In column 10, at line 55, change the numeral "2" to --1--.

In column 12, at line 12, change "th" to --the--.

Signed and Sealed this

*Eighth* Day of *June 1982*

[SEAL]

*Attest:*

GERALD J. MOSSINGHOFF

*Attesting Officer*

*Commissioner of Patents and Trademarks*